US005975214A

United States Patent [19]

Okamura et al.

[11] Patent Number: 5,975,214

[45] Date of Patent: Nov. 2, 1999

[54] WORKING MACHINE CONTROL DEVICE FOR CONSTRUCTION MACHINERY

[75] Inventors: Kenji Okamura, Hiratsuka; Hiroshi Yoshinada, Machida; Kunikazu Yanagi, Hiratsuka; Naritoshi Ohtsukasa, Isehara, all of Japan

[73] Assignee: Komatsu, Ltd., Tokyo, Japan

[21] Appl. No.: 09/014,017

[22] Filed: Jan. 27, 1998

[30] Foreign Application Priority Data

Jan. 31, 1997 [JP] Japan ..... 9-018836

[51] Int. Cl.[6] ..... E02F 3/00

[52] U.S. Cl. ..... 172/2; 37/414

[58] Field of Search ..... 172/2, 7, 8, 12; 37/414–416

[56] References Cited

U.S. PATENT DOCUMENTS

| | | | |
|---|---|---|---|
| 5,528,843 | 6/1996 | Rocke | 172/2 X |
| 5,572,809 | 11/1996 | Steenwyk et al. | 172/2 X |
| 5,713,419 | 2/1998 | Kaczmarski et al. | 172/2 |
| 5,752,333 | 5/1998 | Nakagawa et al. | 172/2 X |
| 5,768,811 | 6/1998 | Cooper | 172/2 X |
| 5,810,095 | 9/1998 | Orbach et al. | 172/2 |
| 5,826,666 | 10/1998 | Tozawa et al. | 172/2 X |

*Primary Examiner*—Christopher J. Novosad
*Attorney, Agent, or Firm*—Greer, Burns & Crain, Ltd.

[57] ABSTRACT

A working machine control device for construction machinery provided with a plurality of joined working arms, an attachment mounted to the leading end of the working arms and a plurality of actuators for driving the working arms and the attachment, includes a function to adjust a pushing force between the attachment and a working plane by automatically controlling at least one of the actuators. The control device also includes a load detecting unit for detecting a load applied from the working plane to the attachment, working machine posture detecting devices for detecting postures of the working arms and the attachment and a computing unit for computing the pushing force between the attachment and the working plane on the basis of output values from the load detecting unit and the working machine posture detecting devices. The computing unit outputs a component of the pushing force in a direction perpendicular to the working plane. A target value setting unit is also provided for setting a target of a component of a pushing force suitable for working in the direction perpendicular to the working plane. A drive control unit automatically controls at least one of the plurality of actuators so that the computed result of the computing unit agrees with the target value set by the target value setting unit.

4 Claims, 3 Drawing Sheets

WORKING MACHINE CONTROL DEVICE FOR CONSTRUCTION MACHINERY

BACKGROUND OF THE INVENTION

1. Field of the Invention

The invention relates to a working machine control device for construction machinery such as a power shovel, by which a pushing force between a working plane and a working attachment can be varied as required and a working plane profiling function is realized to let the working attachment automatically follow along the working plane.

2. Description of the Related Art

Where construction machinery such as a power shovel is used to perform dusting to remove dust and trash from the ground surface or rolling compaction to compact the soft ground, the working plane profiling function is generally performed to let the working attachment automatically follow along a working plane.

The working plane profiling function is generally performed by having a boom (and an arm) in so-called floated state to passively move a working machine depending on a load.

However, the profiling control utilizing the floated state is not effective to apply a relatively large pushing force to the working plane, and the pushing force cannot be set to an arbitrary value.

The power shovel is often provided with a horizontal excavating function to level the ground. The horizontal excavating function drives the boom automatically so as to keep the arm end point or the bucket blade end point at a predetermined height in correspondence with manual operation of the arm and the bucket. Specifically, the horizontal excavating function controls to always keep the arm end point or the bucket blade end point at the same absolute height regardless of irregularities of the ground. Therefore, the horizontal excavating function cannot be used for the dusting work to remove dust and trash from the uneven ground or for the rolling compaction work.

The invention was achieved in view of the above circumstances and aims to provide a working machine control device for construction machinery, which enables to achieve working by an arbitrary pushing force.

The invention also aims to provide a working machine control device for construction machinery, which enables to achieve profiling work by an arbitrary pushing force with a relatively simple configuration without requiring delicate manipulation by an operator.

SUMMARY OF THE INVENTION

The invention relates to construction machinery provided with a plurality of joined working arms, an attachment mounted to a leading end of the working arms and a working machine having a plurality of actuators for driving the working arms and the attachment, and having a function to adjust a pushing force between the attachment and a working plane by automatically controlling at least one of the actuators, which comprises load detecting means for detecting a load applied from the working plane to the attachment; working machine posture detecting means for detecting postures of the plurality of working arms and the attachment; computing means for computing the pushing force between the attachment and the working plane on the basis of output values from the load detecting means and the working machine posture detecting means and computing to output a component of the pushing force in a direction perpendicular to the working plane; target value setting means for setting a target value of a component of a pushing force suitable for working in a direction perpendicular to the working plane; and drive control means for automatically controlling at least one of the actuators so that a computed result by the computing means agrees with the target value set by the target value setting means.

According to the invention, the pushing force adjusting actuator is automatically driven so that a vertical component of the actually measured pushing force against the working plane always agrees with the target value, thereby achieving the work by an arbitrary pushing force. Thus, the invention can automatically achieve the work by the arbitrary pushing force onto a working plane having unknown irregularities without requiring manual operation by an operator, and also improves work efficiency.

The invention also relates to construction machinery provided with a plurality of joined working arms, an attachment mounted to the leading end of the working arms and a working machine having a plurality of actuators for driving the working arms and the attachment, and having a function to adjust a pushing force between the attachment and a working plane by automatically controlling at least one of the actuators, which comprises load detecting means for detecting a load applied from a working plane to the attachment; working machine posture detecting means for detecting postures of the plurality of working arms and the attachment; computing means for computing the pushing force between the attachment and the working plane on the basis of output values from the load detecting means and the working machine posture detecting means and computing to output a component of the pushing force in a direction perpendicular to the working plane; target value setting means for setting a target value of a component of a pushing force suitable for working in a direction perpendicular to the working plane; and drive control means for automatically controlling at least one of the plurality of actuators so that a computed result by the computing means agrees with the target value set by the target value setting means and driving the other actuators to produce an advancing force to the attachment thereby performing a profiling work.

According to the invention, the pushing force adjusting actuator is automatically driven so that a vertical component of the actually measured pushing force against the working plane always agrees with the target value, thereby achieving the working plane profiling control. Thus, the invention can automatically achieve the working plane profiling work by the arbitrary pushing force onto the working plane having unknown irregularities without requiring manual operation by an operator, and also improves work efficiency.

DESCRIPTION OF THE PREFERRED EMBODIMENTS

Embodiments of the invention will be described in detail with reference to the accompanying drawings.

Figure 2:
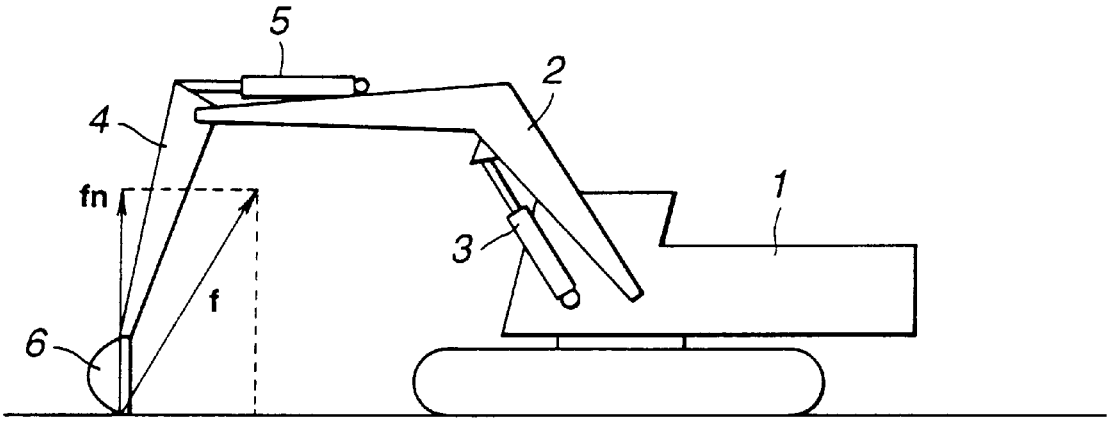
FIG. 2 is a diagram showing the appearance structure of a power shovel according to an embodiment of the invention.

FIG. 2 shows a power shovel to which the invention is applied, in which reference numeral 1 denotes a vehicle body, 2 a boom as a working arm for adjusting a pushing force, 3 a boom cylinder, 4 an arm as a working arm for adjusting an advancing force, 5 an arm cylinder, and 6 a bucket as a working attachment. A bucket cylinder was omitted from the drawing.

Figure 1:
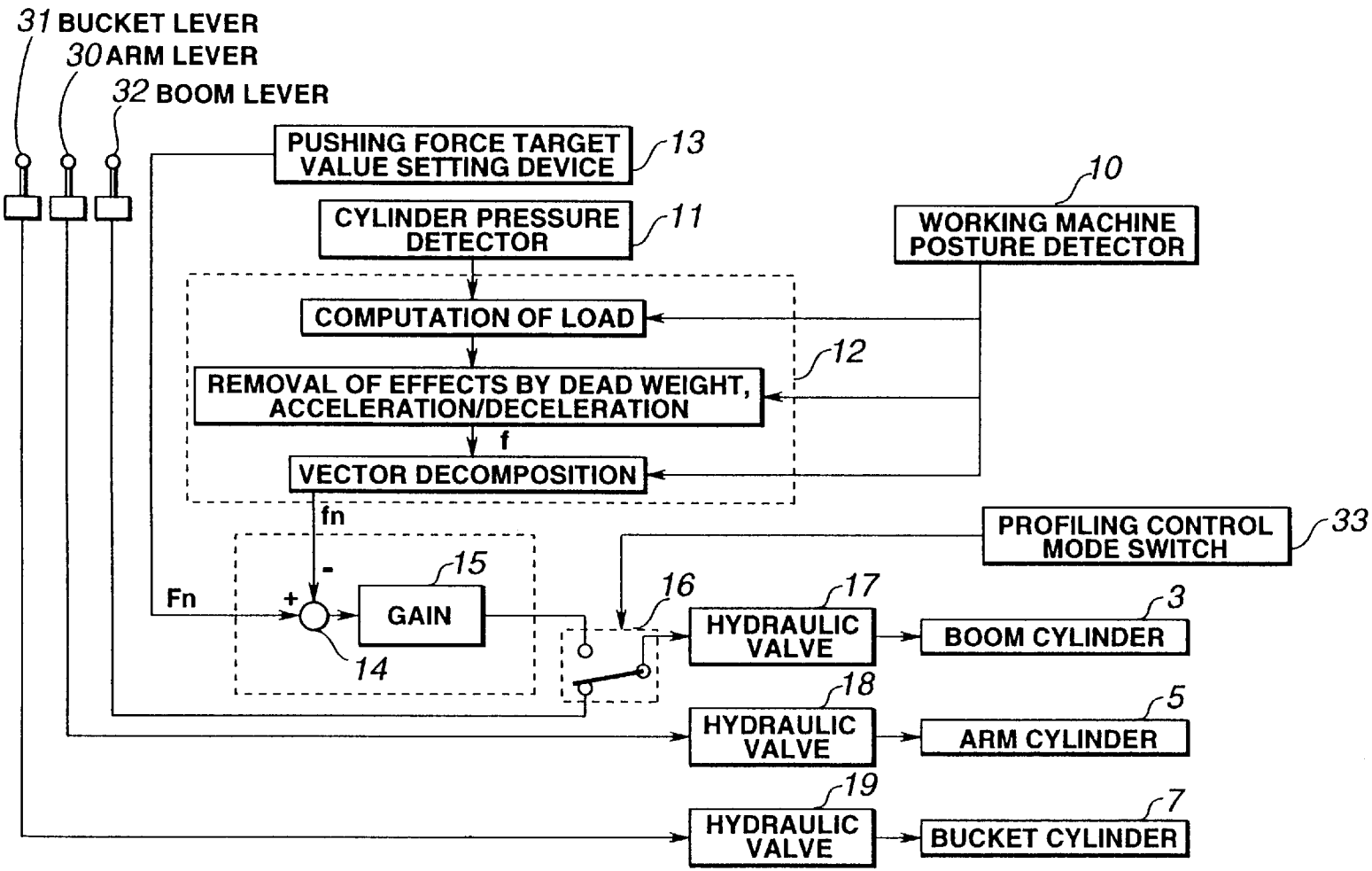
FIG. 1 is a block diagram showing the structure of a control system according to an embodiment of the invention.

FIG. 1 shows the structure of a control drive system for performing a profiling work function. This profiling work function is semiautomatic in that the arm 4 and the bucket 6 are manually operated and the boom 2 only is automatically controlled.

Specifically, in FIG. 1, lever command signals are directly entered from an arm operating lever 30 and a bucket operating lever 31 into a hydraulic valve 18 for the arm and a hydraulic valve 19 for the bucket. A lever command signal is entered from a boom operating lever 32 into a hydraulic valve 17 for the boom through a changeover switch 16. The changeover switch 16 connects its input contact with an amplifier 15 when a profiling control mode switch 33 is on and with the boom operating lever 32 when the profiling control mode switch 33 is off.

In FIG. 1, a working machine posture detector 10 may be a potentiometer disposed on a rotary fulcrum of the boom 2, the arm 4 and the bucket 6 to detect the postures (a boom angle, an arm angle, a bucket angle) of the respective working machines. The detected angles of the working machines are entered into a computer 12.

A cylinder pressure detector 11 detects a hydraulic pressure of each working machine cylinder (the boom cylinder 3, the arm cylinder 5, a bucket cylinder 7) and enters the detected output into the computer 12.

The computer 12 computes a load to be applied to the bucket 6 based on the detected output from the cylinder pressure detector 11, removes the effects due to dead weight and acceleration/deceleration from the computed load, makes correction with a power transmission ratio from the bucket 6 to each cylinder pressure detector 11 taken into account, determines the corrected result as load (pushing force) f from the work plane, and makes vector decomposition of the determined pushing force f with the use of the output from the working machine posture detector 10 to thereby compute a component fn of the pushing force in a direction perpendicular to the ground surface. The computed vertical component fn of the pushing force is entered into an adding point 14.

A pushing force target value setting device 13 sets and enters a target value Fn of the vertical component of the pushing force f with respect to the ground surface. The target value Fn is entered into the adding point 14.

The adding point 14 determines a deviation between the target value Fn and the actually measured value fn, and enters the deviation (Fn−fn) as a command signal into the hydraulic valve 17 for the boom through the amplifier 15 and the changeover switch 16.

In the control configuration described above, when the profiling control mode switch 33 is turned on, the boom is automatically controlled for its vertical movement so that the measured vertical component fn of the pushing force against the ground surface is kept to agree with the set target value Fn. As a result, even when the ground has an uneven surface, the bucket is moved along the uneven surface of the ground by the set pushing force Fn.

Figure 3:
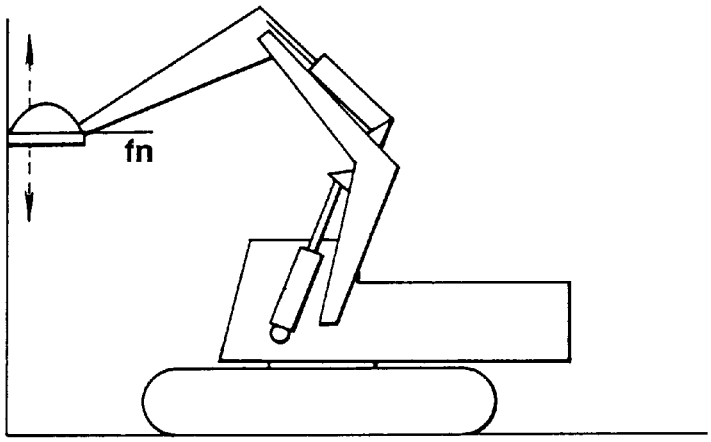
FIG. 3 is a diagram illustrating another embodiment of the invention.

FIG. 3 shows another embodiment of the invention, in which the invention is not applied to the ground surface work as in the previous embodiment but to scraping work of a vertical wall. Specifically, the boom is controlled to move so that the vertical component fn of the pushing force against the vertical wall agrees with the target value.

Figure 4:
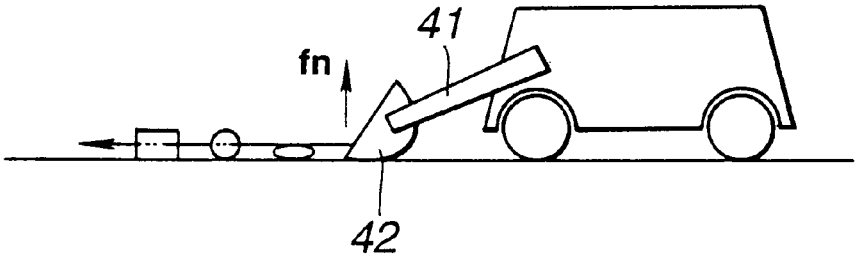
FIG. 4 is a diagram illustrating another embodiment of the invention.

FIG. 4 shows another embodiment of the invention, in which a wheel loader is provided with a working plane profiling function. Specifically, the wheel loader adjusts the pushing force against the working plane by a boom 41 and performs its work by generating an advancing force by running the wheel loader. And, the boom 41 is controlled to move vertically so that a reaction force fn from the ground surface in response to the pushing force by the bucket 42 agrees with the target value. The present invention may also be applied to other construction machinery other than the power shovel and the wheel loader.

Figure 5:
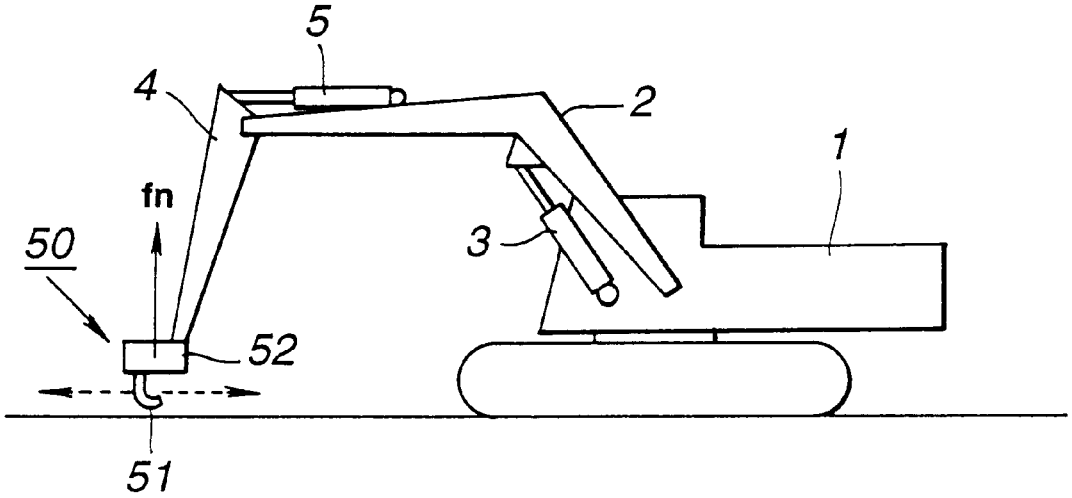
FIG. 5 is a diagram illustrating another embodiment of the invention.

FIG. 5 shows another embodiment of the invention, in which a working attachment 50 has a pushing force adjusting function. The reaction force fn of the pushing force by the working attachment is adjusted not by controlling the boom but by using the pushing force adjusting function of the working attachment 50. Specifically, the working attachment 50 is configured so that an attachment body 51 is free to move vertically with respect to an attachment housing 52. And, the pushing force against the working plane is adjusted by the vertical movement of the attachment body 51.

To perform the profiling control function in the above embodiment, the bucket and the arm were manually operated and the boom only was automatically moved. But, the arm and the bucket may be controlled automatically to agree the pushing force with the target value. Moreover, the bucket, the arm and the boom may be controlled automatically.

In the above embodiment, the target value Fn of the pushing force was set by the pushing force target value setting device 13. But, the target value Fn of the pushing force may be set variably with the target value kept constant while changing a weight of the attachment 6 or by purposely changing for a predetermined value the detected values of the respective working machine postures detected by the working machine posture detector 10.

Furthermore, the target value setting device 13 may automatically set the target value of the pushing force in accordance with working conditions such as a working duration or a working machine posture.

In the embodiment shown in FIG. 1, the pushing force adjusting working machine was a boom, one of the working machines. But, a two-boom type power shovel may control its two booms vertically to adjust the pushing force. Besides, the pushing force adjusting actuator may be three or more. And, the plurality of pushing force adjusting actuators may be switched selectively in accordance with work contents and work postures.

A load applied to the attachment was measured from a hydraulic pressure applied to each working machine's cylinder in the above embodiments. And, a method of detecting the load is arbitrary, and an additional load detecting device may be attached to the leading end of the attachment. Since a load owing to the dead weight of the working machine or the acceleration or deceleration of the vehicle is not transmitted to the load detecting device, a computing process for excluding such a load can be omitted.

What is claimed is:

1. A working machine control device for construction machinery provided with a plurality of joined working arms, an attachment mounted to a leading end of the working arms and a working machine having a plurality of actuators for driving the working arms and the attachment, and having a function to adjust a pushing force between the attachment and a working plane by automatically controlling at least one of the actuators, comprising:

load detecting means for detecting a load applied from the working plane to the attachment;

working machine posture detecting means for detecting postures of the plurality of working arms and the attachment;

computing means for computing the pushing force between the attachment and the working plane on the basis of output values from the load detecting means and the working machine posture detecting means and computing to output a component of the pushing force in a direction perpendicular to the working plane;

target value setting means for setting a target value of a component of a pushing force suitable for working in the direction perpendicular to the working plane; and drive control means for automatically controlling at least one of the actuators so that a computed result by the computing means agrees with the target value set by the target value setting means.

2. The working machine control device for construction machinery according to claim 1, wherein the target value setting means automatically and variably sets the target value of the pushing force in accordance with a working condition including a working duration and a working machine posture.

3. A working machine control device for construction machinery provided with a plurality of joined working arms, an attachment mounted to a leading end of the working arms and a working machine having a plurality of actuators for driving the working arms and the attachment, and having a function to adjust a pushing force between the attachment and a working plane by automatically controlling at least one of the actuators, comprising:

load detecting means for detecting a load applied from the working plane to the attachment;

working machine posture detecting means for detecting postures of the plurality of working arms and the attachment;

computing means for computing the pushing force between the attachment and the working plane on the basis of output values from the load detecting means and the working machine posture detecting means and computing to output a component of the pushing force in a direction perpendicular to the working plane;

target value setting means for setting a target value of a component of a pushing force suitable for working in a direction perpendicular to the working plane; and drive control means for automatically controlling at least one of the plurality of actuators so that a computed result by the computing means agrees with the target value set by the target value setting means and driving the other actuators to produce an advancing force to the attachment thereby performing a profiling work.

4. The working machine control device for construction machinery according to claim 3, wherein the working arm are a boom and an arm, and the attachment is a bucket.

* * * * *